US010837639B2

(12) United States Patent
Bulat

(10) Patent No.: US 10,837,639 B2
(45) Date of Patent: Nov. 17, 2020

(54) BURNER FOR A GAS TURBINE

(71) Applicant: Siemens Aktiengesellschaft, Munich (DE)

(72) Inventor: Ghenadie Bulat, Lincoln (GB)

(73) Assignee: Siemens Aktiengesellschaft, Munich (DE)

( * ) Notice: Subject to any disclaimer, the term of this patent is extended or adjusted under 35 U.S.C. 154(b) by 238 days.

(21) Appl. No.: 15/742,151

(22) PCT Filed: Jun. 10, 2016

(86) PCT No.: PCT/EP2016/063286
§ 371 (c)(1),
(2) Date: Jan. 5, 2018

(87) PCT Pub. No.: WO2017/008963
PCT Pub. Date: Jan. 19, 2017

(65) Prior Publication Data

US 2018/0195723 A1 Jul. 12, 2018

(30) Foreign Application Priority Data

Jul. 13, 2015 (EP) ..... 15176504

(51) Int. Cl.
*F23R 3/14* (2006.01)
*F23R 3/28* (2006.01)
*F23R 3/20* (2006.01)

(52) U.S. Cl.
CPC ..... *F23R 3/14* (2013.01); *F23R 3/20* (2013.01); *F23R 3/286* (2013.01); *F23D 2900/14701* (2013.01)

(58) Field of Classification Search
CPC ..... F05D 2240/36; F23C 7/004; F23D 5/18; F23D 11/383; F23D 11/402;
(Continued)

(56) References Cited

U.S. PATENT DOCUMENTS

2005/0257530 A1 11/2005 Zupanc et al.
2008/0041060 A1* 2/2008 Nilsson ..... F23R 3/14 60/737

(Continued)

FOREIGN PATENT DOCUMENTS

CN 101303131 A 11/2008
CN 104566460 A 4/2015

(Continued)

OTHER PUBLICATIONS

EP Search Report dated Jan. 20, 2016, for EP patent application No. 15176504.7.

(Continued)

*Primary Examiner* — Scott J Walthour

(74) *Attorney, Agent, or Firm* — Wolter Vandyke Davis, PLLC

(57) ABSTRACT

A burner for a gas turbine engine has a combustion chamber and a swirler adapted to guide a swirler air flow to the combustion chamber, wherein the swirler has a first wall confining the swirler air flow as well as a second wall confining the swirler air flow on the same side as and downstream with respect to the swirler air flow from the first wall and being displaced with respect to the first wall in a direction away from the swirler air flow so that a step being able to cause a flow separation of the swirler air flow is formed by the first wall and the second wall, wherein the second wall has a through hole in its surface adapted to inject a liquid fuel into the swirler air flow.

13 Claims, 4 Drawing Sheets

(58) Field of Classification Search
CPC ..... F23D 11/441; F23D 2900/14701; F23R 3/14; F23R 3/20; F23R 3/286; F23R 3/30; F23R 3/32; F23R 3/46; F23R 3/54; F23R 2900/03343
See application file for complete search history.

(56) References Cited

U.S. PATENT DOCUMENTS

| | | | | |
|---|---|---|---|---|
| 2009/0205339 | A1* | 8/2009 | Huang | F23R 3/14 60/737 |
| 2010/0065663 | A1 | 3/2010 | Wilbraham | |

FOREIGN PATENT DOCUMENTS

| | | | |
|---|---|---|---|
| EP | 1890083 | A1 | 2/2008 |
| EP | 1987286 | A1 | 11/2008 |

OTHER PUBLICATIONS

International Search Report dated Aug. 5, 2016, for PCT/EP2016/063286.

* cited by examiner

BURNER FOR A GAS TURBINE

CROSS REFERENCE TO RELATED APPLICATIONS

This application is the US National Stage of International Application No. PCT/EP2016/063286 filed Jun. 10, 2016, and claims the benefit thereof. The International Application claims the benefit of European Application No. EP15176504 filed Jul. 13, 2015. All of the applications are incorporated by reference herein in their entirety.

FIELD OF INVENTION

The invention relates to a burner for a gas turbine.

BACKGROUND OF INVENTION

A burner for a gas turbine can be operated at certain operating conditions by injecting water into the combustion chamber in order to reduce the flame temperature and therefore reducing the emission of $NO_N$. An alternative approach for reducing the emission of $NO_x$ lies in using dry low emission (DLE) burners that are operated without the injection of water and are based on premixing fuel and air prior to combustion. DLE burners emit low concentrations of $NO_x$ and produce compact flames. However, the DLE burners are conventionally designed for a full load operation. In particular, the DLE burners comprise fuel lances for the injection of a liquid fuel into the combustion chamber, wherein the lances are sized such that an efficient atomisation of the liquid fuel and an efficient mixing of the fuel with air occurs at the full load operation.

However, when the burner is operated at a part load operation, the pressure drop over the lances is lower in comparison to the full load operation, which results in a less efficient atomisation than at the full load operation. This leads to a less efficient mixing of the fuel with air and can lead to the formation of fuel ligaments that are deposited on surfaces of the burner where it leads to the formation of a carbon build-up. When the carbon build-up is formed on the lances it can lead to an obstruction of the fuel and when this carbon build-up is formed at an igniter-port it can lead to a reduction in the efficiency of ignition. Furthermore, the less efficient mixing of the fuel with air can lead to the formation of soot that is emitted into the atmosphere.

Conventionally, at the part load operation the DLE combustor is operated such that compressed air is bled from the gas turbine so that less air enters the combustion chamber which raises the flame temperature. With this higher temperature the carbon build-up can at least be partly burned. However, this operation is disadvantageous since it reduces the efficiency of the gas turbine and can not be performed at a part load of less than for example 40% of the full load.

SUMMARY OF INVENTION

It is therefore an object of the invention to provide a burner that can be operated at a part load operation with an efficient atomisation of a liquid fuel and an efficient mixing of the fuel with air.

The burner according to the invention for a gas turbine engine comprises a combustion chamber and a swirler adapted to guide a swirler air flow to the combustion chamber, wherein the swirler comprises a first wall confining the swirler air flow as well as a second wall confining the swirler air flow on the same side as and downstream with respect to the swirler air flow from the first wall and being displaced with respect to the first wall in a direction away from the swirler air flow so that a step being able to cause a flow separation of the swirler air flow is formed by the first wall and the second wall, wherein the second wall has a through hole in its surface adapted to inject a liquid fuel into the swirler air flow. The flow separation caused by the step causes the formation of a multitude of vortices as part of a shear layer downstream with respect to the swirler air flow. Since the liquid fuel is injected via the through hole into the swirler air flow and not by a lance that would protrude from the second wall, the liquid fuel is directly mixed with the air when exiting the second wall and therefore interacts with the vortices. This interaction leads to an efficient atomisation of the liquid fuel and an efficient mixing with air. The atomisation and the mixing will also be efficient at a part load operation of the burner when the pressure drop of the liquid fuel over the through hole is lower than at a full load operation of the burner. Furthermore, the through holes require a smaller pressure drop than the lances. Also for this reason an efficient atomisation of the liquid fuel can take place at low part loads.

It is advantageous that the swirler comprises at least one further wall confining the swirler air flow on the same side as and downstream with respect to the swirler air flow from the second wall, wherein each of the further walls is displaced with respect to its directly adjacent and with respect to the swirler air flow upstream wall in a direction away from the swirler air flow so that a respective step being able to cause a flow separation of the swirler air flow is formed by two directly adjacent walls, wherein each further wall has a through hole in its surface adapted to inject the liquid fuel into the swirler air flow. The further walls with the further through holes increase the efficiency of the atomisation and the mixing further.

The distance between two neighboured steps is advantageously at least 2*L, wherein L is the distance from the step to its closet downstream through hole with respect to the swirler air flow downstream and closest through hole. This length ensures an efficient interaction of the liquid fuel with the vortex. It is advantageous that the swirler comprises a multitude of swirler sectors confining the swirler air flow and shaped to cause an angular momentum of the swirler air flow, wherein the swirler sectors are in contact with each of the walls. This advantageously avoids an overhanging part of the swirler sectors with the walls.

The step is advantageously located at a radial distance from the burner axis which is from $r_1+0.2*(r_2-r_1)$ to $r_1+0.8*(r_2-r_1)$, wherein $r_2-r_1$ is the distance from the radial inner end of the swirler sectors to the radial outer end of the swirler sectors. In case the combustion chamber is essentially rotationally symmetric around a burner axis, $r_1$ and $r_2$ can be measured from the burner axis. The lower boundary advantageously ensures an efficient interaction of the liquid fuel injected by the with respect to the swirler air flow most downstream through hole with the vortex. The upstream boundary advantageously ensures the formation of the vortex. It is advantageous that the height of each step is from 0.2*L to 0.5*L, wherein L is the distance from the step to its closest downstream through hole. This height advantageously ensures the formation of the vortex that is efficiently interacting with the liquid fuel. It is advantageous that L is from 4 mm to 20 mm, in particular from 4 mm to 8 mm. It is advantageous that the height of each step is at least 1 mm. This height advantageously ensures the formation of the shear layer. It is advantageous that the height of each step is maximum 15% of the swirler channel height, wherein the swirler channel height is the distance from the swirler air flow upstream wall forming the step to an opposite wall confining the swirler air flow and facing towards the upstream wall with respect to the swirler air flow upstream wall forming the step. This maximum height advantageously avoids a large pressure drop of the swirler air flow when passing the step. The diameter of the through hole is advantageously from 0.5 mm to 3 mm.

It is advantageous that the swirler is adapted to guide the swirler air flow such that the air flow entering the combustion chamber has a flow direction with respect to a main flow direction within the combustion chamber, wherein the flow direction essentially consists of a radial inward component and a component in circumferential direction. In case the combustion chamber is essentially rotationally symmetric around a burner axis, the main flow direction within the combustion chamber coincides with the burner axis. The burner is configured for dry operation only. It is advantageous that the burner is adapted to generate a premixed flame.

BRIEF DESCRIPTION OF THE DRAWINGS

The above mentioned attributes and other features and advantages of this invention and the manner of attaining them will become more apparent and the invention itself will be better understood by reference to the following description of embodiments of the invention taken in conjunction with the accompanying drawings, wherein.

DETAILED DESCRIPTION OF INVENTION

Figure 1:
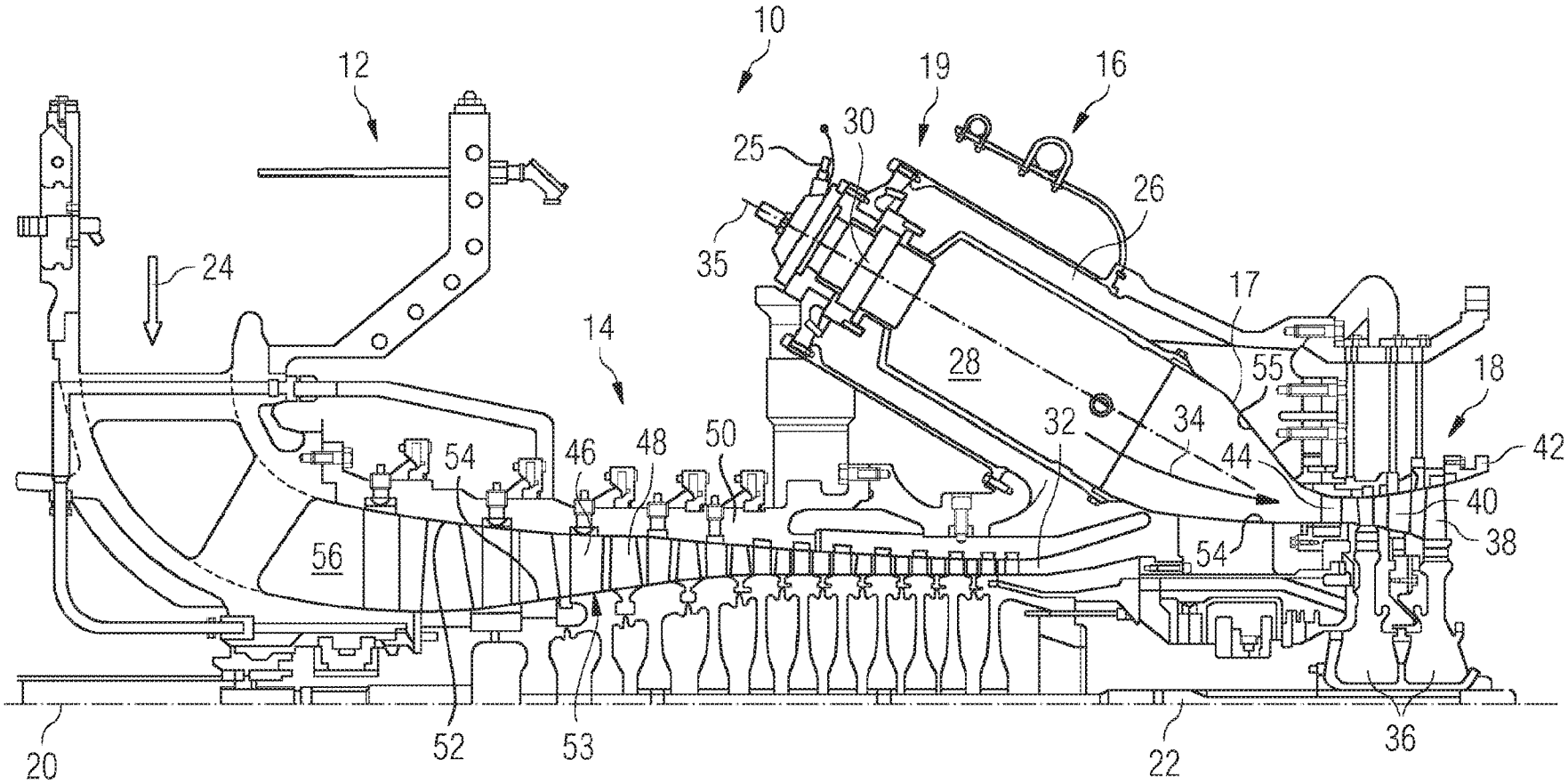
FIG. 1 shows part of a gas turbine in a sectional view and in which the present inventive burner is incorporated.

FIG. 1 shows an example of a gas turbine engine 10 in a sectional view. The gas turbine engine 10 comprises, in flow series, an inlet 12, a compressor section 14, a combustor section 16 and a turbine section 18 which are generally arranged in flow series and generally about and in the direction of a longitudinal or rotational axis 20. The gas turbine engine 10 further comprises a shaft 22 which is rotatable about the rotational axis 20 and which extends longitudinally through the gas turbine engine 10. The shaft 22 drivingly connects the turbine section 18 to the compressor section 14.

In operation of the gas turbine engine 10, air 24, which is taken in through the air inlet 12 is compressed by the compressor section 14 and delivered to the combustion section or burner section 16. The burner section 16 comprises a burner plenum 26, one or more combustion chambers 28 and at least one burner 30 fixed to each combustion chamber 28. The combustion chambers 28 and the burners 30 are located inside the burner plenum 26. The compressed air passing through the compressor 14 enters a diffuser 32 and is discharged from the diffuser 32 into the burner plenum 26 from where a portion of the air enters the burner 30 and is mixed with a gaseous or liquid fuel. The air/fuel mixture is then burned and the combustion gas 34 or working gas from the combustion is channelled through the combustion chamber 28 to the turbine section 18 via a transition duct 17.

This exemplary gas turbine engine 10 has a cannular combustor section arrangement 16, which is constituted by an annular array of combustor cans 19 each having the burner 30 and the combustion chamber 28, the transition duct 17 has a generally circular inlet that interfaces with the combustor chamber 28 and an outlet in the form of an annular segment. An annular array of transition duct outlets form an annulus for channelling the combustion gases to the turbine 18.

The turbine section 18 comprises a number of blade carrying discs 36 attached to the shaft 22. In the present example, two discs 36 each carry an annular array of turbine blades 38. However, the number of blade carrying discs could be different, i.e. only one disc or more than two discs. In addition, guiding vanes 40, which are fixed to a stator 42 of the gas turbine engine 10, are disposed between the stages of annular arrays of turbine blades 38. Between the exit of the combustion chamber 28 and the leading turbine blades 38 inlet guiding vanes 44 are provided and turn the flow of working gas onto the turbine blades 38.

The combustion gas from the combustion chamber 28 enters the turbine section 18 and drives the turbine blades 38 which in turn rotate the shaft 22. The guiding vanes 40, 44 serve to optimise the angle of the combustion or working gas on the turbine blades 38.

The turbine section 18 drives the compressor section 14. The compressor section 14 comprises an axial series of vane stages 46 and rotor blade stages 48. The rotor blade stages 48 comprise a rotor disc supporting an annular array of blades. The compressor section 14 also comprises a casing 50 that surrounds the rotor stages and supports the vane stages 48. The guide vane stages include an annular array of radially extending vanes that are mounted to the casing 50. The vanes are provided to present gas flow at an optimal angle for the blades at a given engine operational point. Some of the guide vane stages have variable vanes, where the angle of the vanes, about their own longitudinal axis, can be adjusted for angle according to air flow characteristics that can occur at different engine operations conditions.

The casing 50 defines a radially outer surface 52 of the passage 56 of the compressor 14. A radially inner surface 54 of the passage 56 is at least partly defined by a rotor drum 53 of the rotor which is partly defined by the annular array of blades 48.

The present invention is described with reference to the above exemplary turbine engine having a single shaft or spool connecting a single, multi-stage compressor and a single, one or more stage turbine. However, it should be appreciated that the present invention is equally applicable to two or three shaft engines and which can be used for industrial, aero or marine applications.

Figure 2:
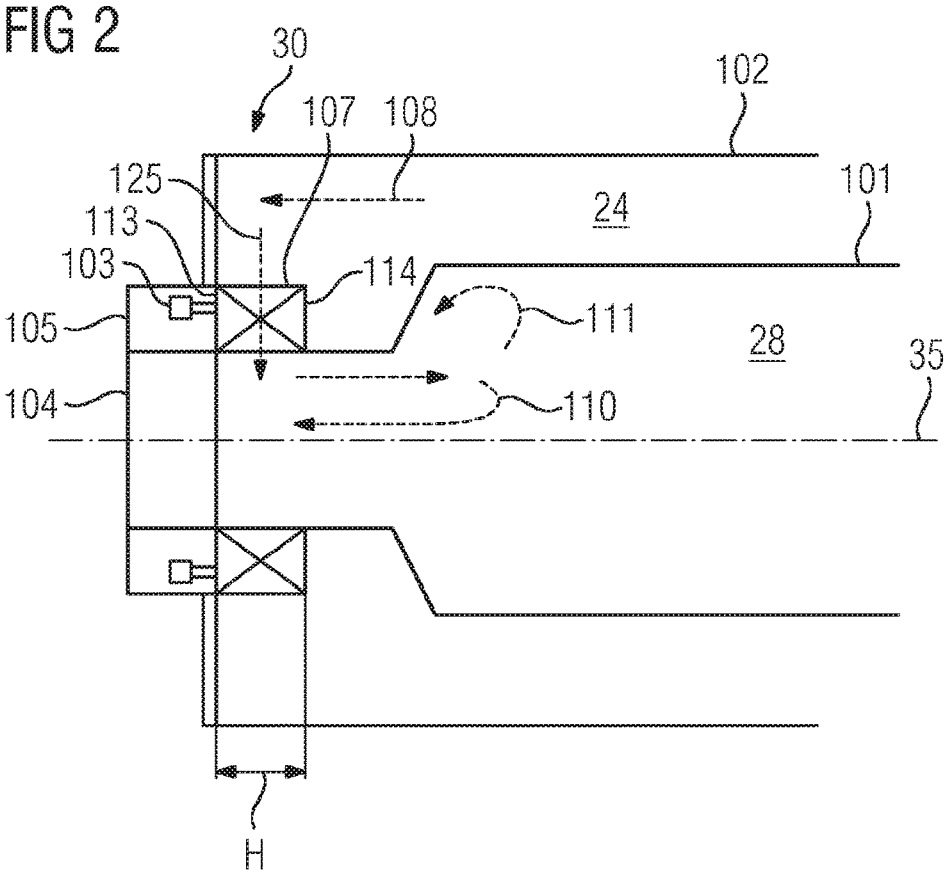
FIG. 2 shows a longitudinal section of the burner and a part of the combustion chamber.

FIG. 2 shows that the burner 30 comprises an inner wall 101 that confines the combustion chamber 28 in a radial direction. Furthermore, the burner 30 comprises a pilot burner 104 and a main burner 105 that are arranged on an axial end of the burner 30. The main burner 105 is arranged radially outside from the pilot burner 104. The burner 30 comprises an outer wall 102 that is arranged radially outside of the inner wall 101. The inner wall 101 and the outer wall 102 are essentially rotationally symmetric around a burner axis 35 of the burner 30. The air 24 is streamed in the space between the inner wall 101 and the outer wall 102 towards the pilot burner 104 and the main burner 105 as indicated by arrows 108, so that the inner wall 101 is cooled and the air 24 is preheated before it enters the combustion chamber 28.

The burner 30 comprises a swirler 107 located on the main burner 105 for swirling the air before it enters the combustion chamber 28. After passing the space between the inner wall 101 and the outer wall 102 the air 24 passes through the swirler 107 in a direction towards the burner axis 35 and enters the combustion chamber 28. The burner 30 is configured for dry operation only, i.e. it is not configured for the injection of water into the combustion chamber 28.

The swirler 107 comprises a first axial end 113 that coincides with the main burner 105 and a second axial end 114 being located opposite to the first axial end 113. As it can be seen in FIGS. 3 and 5, the swirler 107 furthermore comprises a multitude of swirler sectors 118 that are in contact with the first axial end 113 and the second axial end 114. The first axial end 113, the second axial end 114 and the swirler sectors 118 confine a swirler air flow 125. The swirler sectors 118 are shaped such that the air flow entering the combustion chamber 28 has a flow direction with respect to the burner axis 35, wherein the flow direction essentially consists of a radial inward component and a component in circumferential direction.

Figure 3:
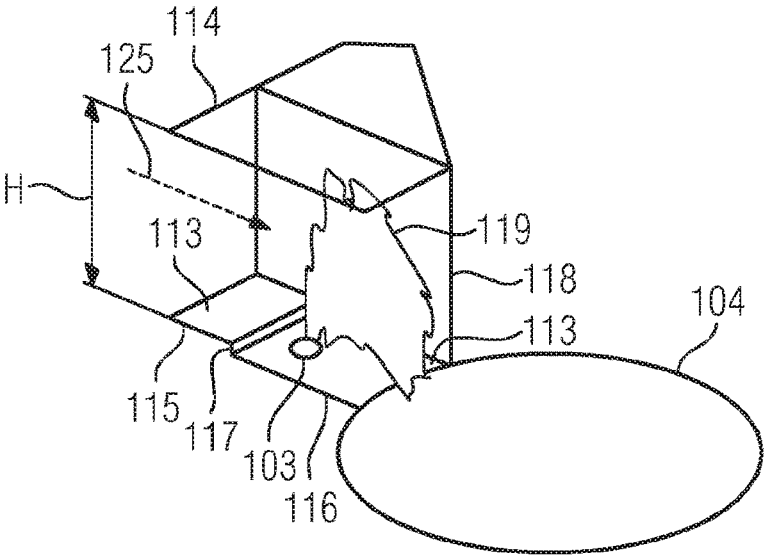
FIG. 3 shows a perspective view of a part of the a swirler of the burner.

FIGS. 2 and 3 show that the swirler 107 comprises a first wall 115 that confines the swirler air flow 125 at the first axial end 113 as well as a second wall 116 that confines the swirler air flow 125 on the same side as, i.e. also at the first axial end 113, and downstream with respect to the swirler air flow 125 from the first wall 115. The second wall 116 is displaced with respect to the first wall 115 in an axial direction with respect to the burner axis 35 away from the swirler air flow 125 so that a step 117 being able to cause a flow separation of the swirler air flow 125 is formed by the first wall 115 and the second wall 116. The main burner 105 comprises a through hole 103 that extends through the second wall 116. Via the through hole 103 a liquid fuel can be injected into the swirler air flow 125. The burner 30 does not comprise fuel lances so that the liquid fuel is in contact with the through hole 103 and is immediately in contact with the swirler air flow 125 when leaving the through hole 103.

Figure 4:
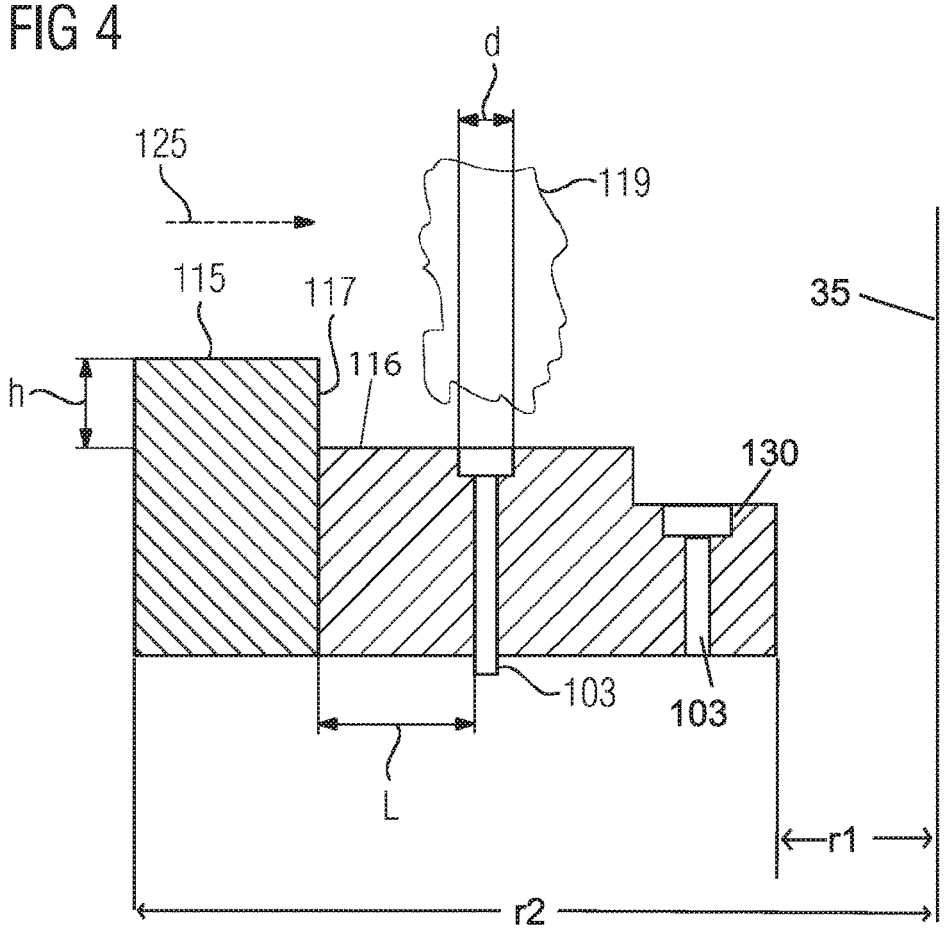
FIG. 4 shows a sectional view of a part of the swirler.

As it can be seen in FIGS. 3 and 4, an atomisation region 119 is formed within the swirler air flow 125 directly beginning from where the liquid fuel enters the swirler air flow 125. A large part of the atomisation region 125 overlaps with the vortex caused by the flow separation of the swirler air flow 125 on the step 117 which results in a particular efficient atomisation of the liquid fuel and mixing of the liquid fuel with air.

The step 117 is located at a radial distance from the burner axis 35 which is from $r_1+0.2*(r_2-r_1)$ to $r_1+0.8*(r_2-r_1)$, wherein $r_1$ is the radial distance from the burner axis to the radial inner end of the swirler sectors 118 and $r_2$ is the radial distance from the burner axis to the radial outer end of the swirler sectors 118. The height h of each step 117 is from 0.2*L to 0.5*L, wherein L is the distance from the step 117 to its closest downstream through hole 103. The height h of each step 117 is maximum 15% of the swirler channel height H. The swirler channel height H is the distance from the upstream wall 115 forming the step 117 to an opposite wall confining the swirler air flow 125 and facing towards the upstream wall 115 forming the step 117.

After the premixing of the liquid fuel with the air, the mixture enters the combustion chamber 28, where the combustion of the mixture occurs. The flame in the combustion chamber 28 has an inner recirculation zone 110 that stabilises the flame by transporting hot combustion products to the unburned air/fuel mixture, and an outer recirculation zone 111.

As can be seen in the FIGS. 3 and 4 fuel is injected perpendicularly with respect to the direction of the air flow 125. This fuel injection angle can be also described as parallel to the burner axis 35. The through hole 103 and/or at least its outlet end or nozzle is also arranged generally parallel to the burner axis 35 and therefore perpendicular to the direction of air flow 35. In this arrangement the fuel injected is mixed particularly well by the vortices created by the airflow over the step 117. The stated dimensions H, h and L are particularly well suited to this arrangement of a perpendicular fuel injection relative to the airflow direction. The terms perpendicular and parallel are intended to be approximate and directions angled up to 30° away from nominally parallel or perpendicular are intended to be within the scope of these terms as used here. The direction of the fuel injected is a nominal angle of the fuel spray centre-line rather than a cone angle of the fuel spray.

The vortices created by the step 117 are particularly suited to providing good mixing of the fuel and air under low or part power conditions where there would otherwise be less mixing than desirable to minimise emissions.

Figure 5:
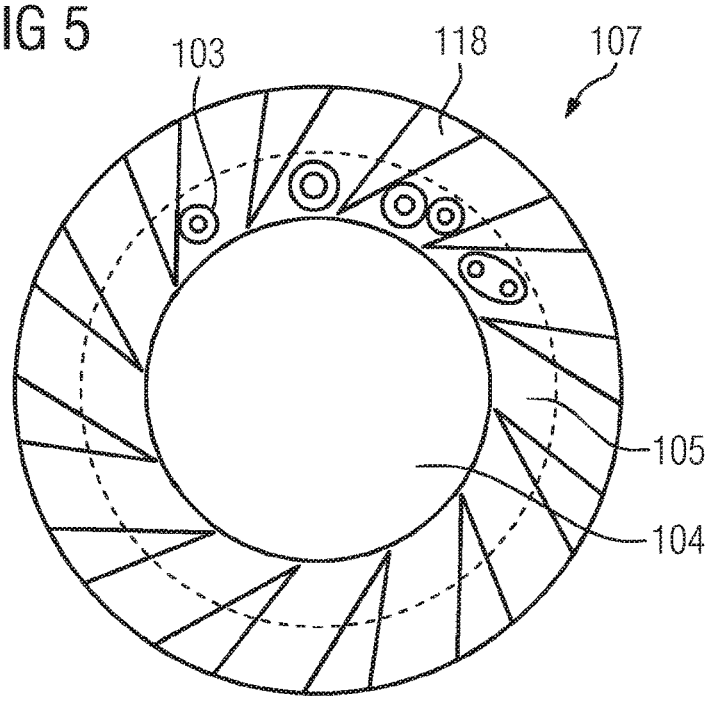
FIG. 5 shows a top view of the burner.
Figure 6:
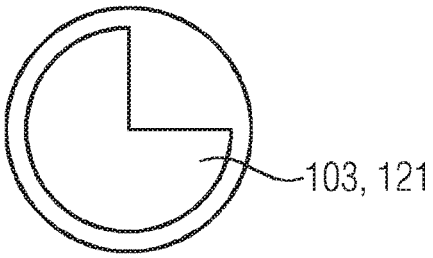
FIGS. 6 to 10 show different embodiments for through holes of the swirler.
Figure 7:
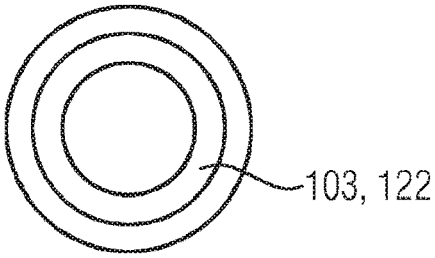
Figure 8:
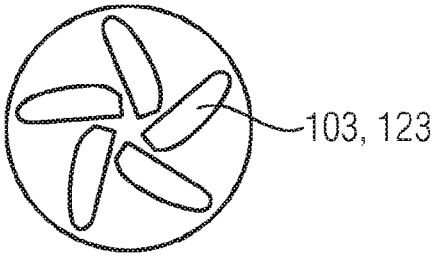
Figure 9:
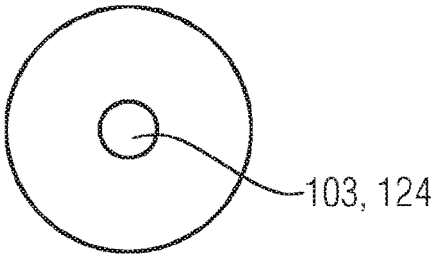

As it can be seen in FIG. 5 the swirler 107 and the step 117 have the form of an ellipse, wherein other forms, e.g. a circle, are also conceivable. At least one through hole 103 is located between two adjacent swirler sectors.

It is conceivable that the swirler 107 comprises at least one further wall 130 confining the swirler air flow 125 on the first axial end 113 and downstream with respect to the swirler air flow 125 from the second wall 116, wherein each of the further walls is displaced in an axial direction with respect to its directly adjacent and with respect to the swirler air flow 125 upstream wall in a direction away from the swirler air flow 125 so that a respective step being able to cause a flow separation of the swirler air flow 125 is formed by two directly adjacent walls, wherein each further wall has a through hole 103 in its surface adapted to inject the liquid fuel into the swirler air flow 125. The distance between two neighboured steps is at least 2*L. It is conceivable that the steps are arranged parallel to each other.

Figure 10:
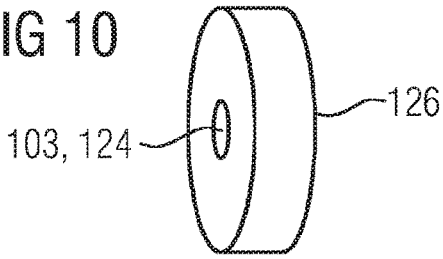

FIGS. 6 to 10 show possible geometries for the through holes 103. The first through hole 121 according to FIG. 6 has the shape of a circle with a missing sector having an angle of 90°. The second through hole 122 according to FIG. 7 has the shape of a ring. The through hole 123 according to FIG. 8 consists of a plurality of elongate through holes that are arranged tilted with respect to each other. The through hole 124 according to FIG. 9 has the form of a circle. FIG. 10 shows a perspective view of a plate 126 containing the through hole 124 according to FIG. 9. The through holes 103 can be formed as an assembly of several joint layers of metal.

Although the invention is described in detail by the preferred embodiment, the invention is not constrained by the disclosed examples and other variations can be derived by the person skilled in the art, without leaving the extent of the protection of the invention.

The invention claimed is:

1. A burner for a gas turbine engine, wherein the burner comprises:

a combustion chamber, and a swirler bound by an axially forward end and an axially aft end with respect to a burner axis and adapted to guide a swirler air flow to the combustion chamber, the swirler comprising a multitude of swirler sectors that are in contact with the axially forward end and the axially aft end, wherein the axially forward end, the axially aft end, and the multitude of swirler sectors confine the swirler air flow, wherein the swirler comprises:

a first wall at the axially forward end of the burner, a second wall disposed radially inward of the first wall and recessed axially forward of the first wall and away from the swirler air flow, and a riser wall connecting the first wall to the second wall, wherein the first wall, the riser wall, and the second wall form a first step configured to cause a flow separation of the swirler air flow flowing thereover, wherein the second wall comprises a second wall surface comprising a second wall through hole configured to inject a liquid fuel into the swirler air flow, wherein the second wall through hole is angled up to thirty (30) degrees from parallel with the burner axis, and wherein a height of the riser wall, measured from the second wall to the first wall, is from 0.2*L to 0.5*L, wherein L is a distance in a radially inward direction from the riser wall to the second wall through hole.

2. The burner according to claim 1, wherein the swirler comprises a third wall disposed radially inward of the second wall and recessed axially forward of the second wall away from the swirler air flow, and a second riser wall connecting the second wall to the third wall, wherein the second wall and the third wall form a second step configured to cause a second flow separation of the swirler air flow flowing thereover, wherein the third wall comprises a third wall through hole configured to inject the liquid fuel into the swirler air flow, and wherein the third wall through hole is angled up to thirty (30) degrees from parallel with the burner axis.

3. The burner according to claim 2, wherein a distance between the riser wall and the second step is at least 2*L.

4. The burner according to claim 1, wherein the multitude of swirler sectors are shaped to cause an angular momentum of the swirler air flow around the burner axis.

5. The burner according to claim 4, wherein the riser wall is located at a radial distance from the burner axis which is from r1+0.2*(r2-r1) to r1+0.8*(r2-r1), wherein r1 is a radial distance from the burner axis to a radial inner end of the multitude of swirler sectors, wherein r2 is a radial distance from the burner axis to a radial outer end of the multitude of swirler sectors, and wherein r2-r1 is a distance from the radial inner end of the multitude of swirler sectors to the radial outer end of the multitude of swirler sectors.

6. The burner according to claim 1, wherein L is from 4 mm to 20 mm.

7. The burner according to claim 1, wherein the height of the riser wall is at least 1 mm.

8. The burner according to claim 7, wherein the height of the riser wall is at most 15% of a swirler channel height (H), and wherein the swirler channel height (H) is a distance from the first wall to an opposite wall at the axially aft end, wherein the opposite wall faces the first wall and confines the swirler air flow.

9. The burner according to claim 1, wherein a diameter of the second wall through hole is from 0.5 mm to 3 mm.

10. The burner according to claim 1, wherein the swirler is adapted to guide the swirler air flow radially inward toward and circumferentially around the burner axis.

11. The burner according to claim 1, wherein the burner is configured for dry operation only.

12. The burner according to claim 1, wherein the burner is adapted to generate a premixed flame.

13. The burner according to claim 1, wherein L is from 4 mm to 8 mm.

* * * * *